US012595664B2

(12) United States Patent
Clement et al.

(10) Patent No.: US 12,595,664 B2
(45) Date of Patent: Apr. 7, 2026

(54) WALL OR CEILING PANEL ASSEMBLY, A SET OF PANELS FOR FORMING SUCH ASSEMBLY AND A WALL OR CEILING OBTAINED THEREWITH

(71) Applicant: FLOORING INDUSTRIES LIMITED, SARL, Bertrange (LU)

(72) Inventors: Benjamin Clement, Waregem (BE); Laurent Meersseman, Mont de l'Enclus (BE); Jan De Rick, Geraardsbergen (BE); Benny Schacht, Vlamertinge (BE); Bruno Vermeulen, Aldeneik-Maaseik (BE); Lieven Vangheluwe, Ronse (BE); Jonas Deman, Sint-Amandsberg (BE)

(73) Assignee: UNILIN BV, Wielsbeke (BE)

( * ) Notice: Subject to any disclaimer, the term of this patent is extended or adjusted under 35 U.S.C. 154(b) by 321 days.

(21) Appl. No.: 18/039,443

(22) PCT Filed: Nov. 17, 2021

(86) PCT No.: PCT/IB2021/060656
§ 371 (c)(1),
(2) Date: May 30, 2023

(87) PCT Pub. No.: WO2022/118128
PCT Pub. Date: Jun. 9, 2022

(65) Prior Publication Data

US 2024/0003139 A1 Jan. 4, 2024

Related U.S. Application Data

(60) Provisional application No. 63/119,912, filed on Dec. 1, 2020.

(51) Int. Cl.
*E04F 13/00* (2006.01)
*E04F 13/08* (2006.01)
*E04F 13/18* (2006.01)

(52) U.S. Cl.
CPC ..... *E04F 13/18* (2013.01); *E04F 13/0894* (2013.01); *E04F 2201/0153* (2013.01)

(58) Field of Classification Search
CPC ..... E04F 13/0894; E04F 15/02038; E04F 15/107; E04F 13/18; E04F 2201/042;
(Continued)

(56) References Cited

U.S. PATENT DOCUMENTS 9,366,036 B2 6/2016 Pervan
10,697,184 B2 * 6/2020 De Rick ..... E04F 15/02038
(Continued)

FOREIGN PATENT DOCUMENTS

CA 3117806 A1 1/2012
WO 02052113 A2 7/2002
WO 2019003100 A1 1/2019

OTHER PUBLICATIONS

International Search Report from corresponding PCT Application No. PCT/IB2021/060656, Apr. 4, 2022.

*Primary Examiner* — Chi Q Nguyen
(74) *Attorney, Agent, or Firm* — Workman Nydegger

(57) ABSTRACT

A wall or ceiling panel assembly includes: at least one panel of rectangular or oblong shape provided with coupling means on at least two opposite long sidewalls of the panel. The length of the panel is greater than 1200 mm. The panel includes: at least a base layer having a mineral-based filler, and a decorative layer on top of the base layer, a coupling means on at least one long sidewall and a complementary
(Continued)

coupling means on the opposite long sidewall. The panel further has a stiffening member adjacent to one of the long sidewalls.

16 Claims, 7 Drawing Sheets

(58) Field of Classification Search
CPC ..... E04F 2201/0107; E04F 2201/03; E04F 15/08; E04F 2201/0115; E04F 2201/0153; E04F 2201/0552; E04F 2201/023; E04F 2201/0535; E04F 2201/0146; E04F 2201/043; E04F 2201/0547; E04F 2201/0138; B32B 2471/00; B32B 3/06; B32B 7/12; B32B 19/04; B32B 2307/546; B32B 2419/04; B32B 2607/00
See application file for complete search history.

(56) References Cited

U.S. PATENT DOCUMENTS

| | | | | |
|---|---|---|---|---|
| 11,072,929 | B2 * | 7/2021 | De Rick | E04F 13/0894 |
| 11,377,855 | B2 * | 7/2022 | Josefsson | E04F 15/107 |
| 11,739,538 | B2 * | 8/2023 | De Rick | E04F 15/10 52/588.1 |
| 11,834,843 | B2 * | 12/2023 | Schacht | B32B 27/304 |
| 11,891,816 | B2 * | 2/2024 | Ceysson | E04F 15/02038 |
| 11,927,020 | B2 * | 3/2024 | Baert | B32B 27/32 |
| 12,247,405 | B2 * | 3/2025 | Boucké | E04F 15/02038 |
| 12,320,130 | B2 * | 6/2025 | De Rick | E04F 15/02038 |
| 2006/0010820 | A1 | 1/2006 | Schwitte et al. | |
| 2016/0333595 | A1 | 11/2016 | Cappelle et al. | |
| 2016/0340914 | A1 * | 11/2016 | Edmonds | E04B 1/8409 |
| 2019/0186125 | A1 * | 6/2019 | Edmonds | E04B 1/8209 |
| 2020/0308846 | A1 * | 10/2020 | Josefsson | E04F 13/076 |
| 2023/0055973 | A1 * | 2/2023 | De Rick | B32B 3/06 |

* cited by examiner

WALL OR CEILING PANEL ASSEMBLY, A SET OF PANELS FOR FORMING SUCH ASSEMBLY AND A WALL OR CEILING OBTAINED THEREWITH

BACKGROUND

This invention relates to wall or ceiling panel assemblies for covering walls and/or ceilings. The invention also relates to sets of panels for forming such assemblies, as well as to walls or ceilings obtained thereby. The invention further relates to a covering for a wall or a ceiling, as well as to a transition panel and a transition panel assembly applicable therewith.

Panels for mounting on walls or ceilings are well known. They may be installed by gluing to the wall, or by fixing, for example by nailing or screwing, to a supporting structure.

WO 02/052113 discloses a wall panel assembly comprising at least a first panel of a substantially rectangular or oblong shape provided with complementary coupling means on at least a first pair of opposite sidewalls of the panel. Additional fixtures are used to connect the panels to the supporting structure. The complementary coupling means may lead to a visually seamless result. The joints between adjacent panels can be sealed using an elastic sealing means. It is not apparent how the wall panel assembly of WO 02/052113 could be used for making an assembly out of thin or flexible panels, such as so-called LVT (luxury vinyl tile), WPC (waterproof plastic composite) or SPC (solid plastic composite) panels. Furthermore, obtaining a waterproof result requires an additional operation of filling the joints with the elastic sealing means. The wall assembly of WO' 113 may further suffer from changes in the ambient climate conditions, which may lead to uncontrollable defects due to dimensional expansion of the panels.

WO 2019/003100 discloses long panels for assembling a wall covering, wherein the panels may comprise a waterproof core material as a base layer and a watertight foil on its front side. The panels comprise complementary coupling means. Such large panels may be flexible and tend to bend and/or twist during handling, making it difficult for the installer to fluently and properly connect the coupling means. This is especially so when working with thin panels of about 7 mm thickness and less and/or when working with flexible panels such as LVT, WPC or SPC and/or when using coupling means that require a deformation during connection, such as is the case with most interlocking connections. In such cases the coupling parts may be damaged during assembly or may not become assembled at all and subsequently defects may arise prematurely in the wall assembly. Further, the wall assembly of WO'100 may insufficiently cope with dimensional expansion due to changing ambient climate conditions.

SUMMARY

The invention in the first place aims at alternative wall or ceiling assemblies, wherein in accordance with several aspects and/or preferred embodiments a solution is offered for one or more of the drawbacks with the panels or assemblies of the state of the art.

According to a first independent aspect of the invention, there is provided a wall or ceiling panel assembly comprising at least one panel of rectangular or oblong shape provided with coupling means on at least two opposite long sidewalls of said panel, wherein the length of the panel is greater than 1200 mm, the panel comprising at least a base layer comprising a mineral-based filler, and a decorative layer on top of the base layer, a coupling means on at least one long sidewall and a complementary coupling means on the opposite long sidewall, with the characteristic that the panel further comprises a stiffening member adjacent to, or on, one of the long sidewalls.

The stiffening member provides rigidity to the wall panel, thereby reducing the tendency to bending or arching of the panel during handling and installation. Furthermore, locating the stiffening member adjacent to a long sidewall further facilitates the installation, as the increase in rigidity conferred by the stiffening member located adjacent, or on, to a long sidewall can prevent substantial deformation of the panel, but also of the coupling means or complementary coupling means when coupling adjacent panels together with conventional coupling methods.

It is remarked that with "adjacent", it is meant that the stiffening member is on that half of the width of the panel that is closest to the relevant long sidewall.

Preferably said stiffening member is located within a distance of one third of the width of the panel from the relevant long sidewall, and even better within a distance of one fourth of the width.

Preferably, said stiffening member is located within the first five centimeters from the lower edge of the respective long sidewall.

According to the most preferred embodiment said stiffening member extends up to said long sidewall.

Preferably, the stiffening member extends along the whole length of the panel, or substantially the whole length of the panel.

The shape and the material of the stiffening member can be such that they increase, at least locally, the rigidity (e.g. bending stiffness) of the panel. Beam shapes can be used to increase the rigidity of the panel. Cross-section of beams can include oblong, I-beam shape or C-beam shape. Other configurations are however not excluded, as long as the shape increases the area moment of inertia of the panel's cross-section. Even rectangular or oblong sections could provide the required second moment of area to increase the rigidity of the panel.

Alternatively, the location of the stiffening member can further increase the rigidity (e.g. bending stiffness) of the panel. Placing the stiffening member at a location distant from the centre of gravity of the panel, as seen in thickness direction, provided the stiffening member has a substantially significantly higher Young's modulus than the rest of panel, can increase the rigidity of the panel. For instance, the stiffening member can be located at a distance of an axis (X), where (X) is substantially parallel to the layers of the panel, perpendicular to the long sidewalls of the panel, and intersecting the center of gravity of the panel's cross-section.

The stiffening member is preferably located closer to a back side of the panel, than to a front side of the panel. According to a practical embodiment, the stiffening member is located at or on the back side of the panel.

Alternatively, both the shape and the location of the stiffening member, combined with a higher Young's modulus, can be such that they increase the rigidity of the panel.

Alternatively, the stiffening member can comprise multiple stiffening members.

The stiffening member can be adhered on the back side of the panel, for example directly or indirectly on the back side of the base layer, or embedded in the base layer, as appropriate depending on the manufacturing methods available. The adhesion or bonding can be obtained by means of a glue, or by direct lamination of the base layer onto the stiffening member, or reversely by laminating the stiffening member onto the base layer. Alternatively, the stiffening member can even be laminated or bonded to an intermediate layer of the base layer.

In a preferred embodiment, the panel has a width of 200 millimetres or greater. Preferably the length-to-width ratio is at least 6. A panel having such length-to-width ratio would be much more prone to bending and/or arching in the absence of the stiffening member.

The availability of fillers, especially in an amount above 40% or above 60% by weight, increases the bendability of the panels. It is especially in these cases where the invention is most advantageous in limiting bending or arching.

In a preferred embodiment, the stiffening member comprises a thermoplastic polymer, whereas the Young modulus of this thermoplastic polymer is at least one and a half times greater than the young's modulus of the thermoplastic polymer of the base layer, preferably three times greater.

The maximum Young's modulus of PVC, without any kind of filler, is around 4 GPa, so that the stiffening member preferably has a Young's modulus of at least 6 GPa.

Reinforcing fillers can be incorporated in the thermoplastic base material in order to form the thermoplastic polymer of the stiffening member, in order to increase the Young's modulus of the stiffening member. Glass fibers or carbon fibers are examples of such reinforcing fillers that can be used to obtain a greater rigidity. Example combinations of base material and reinforcing fillers that could be used for the stiffening member are given in the matrix below, with their respective Young's modulus:

| Base material | Reinforcing filler | Young's modulus (GPa) |
|---|---|---|
| PE (Polyethylene) | 30% glass fiber | 6.3 |
| PVC | 20% glass fiber | 7 |
| PET (polyethylene terephthalate) | 30% glass fiber | 12 |
| PEEK (polyetheretherketone) | 30% carbon fiber | 22 |

These combinations are given as mere examples and other combinations can be used in order to obtain a stiffening member having a Young's modulus at least one and a half times greater than the Young's modulus of the base layer of the panel.

In a particular embodiment, the stiffening member comprises metal. Preferably, the metal used is a light metal such as extruded aluminium. Thanks to the low density of aluminium, a stiffening member comprising aluminium can significantly increase the rigidity of the panel without influencing too much the weight of the panel. Aluminium has a Young's modulus of about 69 GPa, i.e. around about 20 times the Young's modulus of PVC. It appears clearly that aluminium can greatly increase the bending stiffness of the panel.

According to another particular embodiment, the stiffening member comprises a ferromagnetic material, such as steel. This enables attaching the wall panels by means of magnetic interaction with a support structure provided with magnets.

In at least one embodiment the coupling means is a male coupling element and the complementary coupling means is a female coupling element, and the stiffening member is located adjacent to the male coupling element. It is however possible to have a stiffening member located adjacent to the female coupling element. It is also not excluded to have stiffening members located adjacent to both the male coupling element and the female coupling element.

Preferably the coupling means are such that they can be coupled by means of an angling movement about the associated edge of the panels. While installing it is preferred that the coupling means having the stiffening member adjacent thereto is manipulated, to be introduced in the complementary coupling means of an already installed panel. In this way, the benefits of the invention are maximally used.

According to yet another embodiment, a set of panels for forming a wall or ceiling panel assembly in accordance with the first aspect and/or the preferred embodiments thereof is provided, wherein the set of panels comprises at least two panels.

According to a second independent aspect of the invention, there is provided a wall or ceiling panel assembly comprising at least a first panel of a substantially rectangular or oblong shape provided with coupling means that are complementary to each other on at least a pair of opposite sidewalls of the panel, the coupling means being configured such that two of such panels can be coupled to each other in a plane of the panel, the panel comprising at least a base layer and a decorative layer, at least a second panel substantially similar to the first panel, wherein a coupling means of the first panel and a complementary coupling means of the second panel allow to assemble the first and second panels together by a movement of the coupling means of the second panel, relative to the complementary coupling means of the first panel, said movement being oriented in a direction substantially perpendicular to a plane of the panels, and towards the complementary coupling means of the first panel. Preferably, the coupling means and the complementary coupling means are substantially performed as a male coupling element and a female coupling element which, once coupled, provide a locking effect in at least a direction perpendicular to the plane of the panel, and in a direction perpendicular to the respective sidewalls and in the plane of the panel. Such a connection is better known by the denomination of "push-lock".

Coupling means allowing for a connection using a movement being oriented in a direction substantially perpendicular to the plane of the panels are particularly advantageous since they can be assembled gradually, for example by tapping along the to be joint length of the panels. The tendency to bend or arch is of a lesser concern with this type of coupling means, as it is not required that the panel remains substantially flat for the coupling to be achieved. As an example, an installer could couple a second panel to be coupled to a first panel already attached to a wall or a supporting structure, by positioning the second panel, next to the first panel, preferably covering the complementary coupling means of the first panel with the coupling means of the panel to be installed, and tapping the coupling means of the second panel onto the complementary coupling means of the first panel with a mallet along the joint, for example from the bottom to the top of the panels.

In a preferred embodiment, a length of each panel is greater than 1600 mm. Alternatively, the length of each panel is greater than 2000 mm.

In particular embodiments, a wall or ceiling comprises a wall or ceiling panel assembly and a supporting structure. The supporting structure offers a substantially flat frame to apply the wall or ceiling panel assembly onto. The wall or ceiling panel assembly being preferably adhered to the supporting structure, for example by means of an adhesive. However, alternative fixations means can be foreseen to attach the wall or ceiling panel assembly to the supporting structure. The supporting structure can be attached to an existing wall or ceiling as is typically the case when refurbishing older buildings where the construction methods did not allow to obtain substantially flat surfaces.

In some embodiments, the supporting structure defines two substantially flat surfaces opposed to each other, onto which the panels can be secured, so as to form for example a partition wall. In building construction or in building refurbishment, it is often necessary to split space or large rooms with separators such as partition walls in order to create separate and/or additional rooms. In such case, the supporting structure and the panels define a partition wall. The partition wall can show different decorative layers (ie different decors) on each side. It is not excluded that the supporting structure could be strong enough to be used as a floor separator in a building, such as a mezzanine. In such a case, the panels on an upper face of the supporting structure can be used as floor panels and on the lower face of the supporting structure as ceiling panels.

In particular embodiments, the supporting structure comprises elongated members extending in a direction perpendicular to the length of the panels, said elongated members running substantially parallel to the wall or ceiling. Elongated members can comprise wood members like studs or cleats (e.g. laths), but also metal studs similar to those used for plasterboards.

In particular embodiments, a distance between two neighbouring elongated members of the supporting structure is preferably smaller than 400 mm, more preferably smaller than 250 mm. A short distance (e.g. 250 mm or less) between neighbouring elongated members ensures that the wall or ceiling panel assembly according to the invention remains substantially flat, in particular the supporting structure provides a rigid frame which allows to couple two adjacent panels together without substantial deformation of the panels, thereby improving the coupling process and avoiding damage to the coupling means when the panels to be connected do not remain substantially parallel to each other during installation.

Using a supporting structure with a limited distance between the elongated members is particularly important when working with coupling means that allow a connection by means of a motion in a direction perpendicular to the plane of the panels. In such case the coupling means associated to the panel that is already installed is preferably supported by means of one or more elongated members, such that the force asserted on the coupling means during connection leads to a snap-in of the mechanical coupling means instead of to a deflection resulting in a bad or not coupled condition. Such deflection may in particular be of importance with thin panels, for example having a thickness of 7 millimeters or below, and/or with panels having a thermoplastic basic layer.

Preferably the elongated members are directed transversely, e.g. perpendicularly, to the direction of the edges that are provided with the coupling means allowing for the connection by means of a motion in a direction perpendicular to the plane.

In particular embodiments, the panels are attached onto the supporting structure by means of reusable means such as a hook-and-loop. Hook-and-loop are also sometimes referred to as hook-and-pile. Alternatively, any re-usable means could be used instead of the hook-and-loop means.

In another embodiment, the panels are attached onto the supporting structure by means of an adhesive. The use of adhesives offers certain advantages over other permanent attachment means, such as not damaging or fragilizing the supporting structure with unnecessary drills or nail holes. It also offers a cost-effective, and easy process, and offers greater flexibility in design.

Alternatively, the panels may be provided with ferromagnetic inserts, such as steel inserts. This enables attaching the wall panels by means of magnetic interaction with a support structure provided with magnets.

According to yet another embodiment, a set of panels for forming a wall or ceiling panel assembly in accordance with the second aspect and/or the preferred embodiments thereof is provided, wherein the set of panels comprises at least two panels.

According to a third independent aspect of the invention, there is provided a wall or ceiling panel assembly comprising at least a first panel of a substantially rectangular or oblong shape provided with coupling means on at least a first pair of opposite sidewalls of the panel, said panel comprising at least a base layer and a decorative layer, and a locking member, wherein said locking member comprises complementary coupling means, said complementary coupling means being complementary to the coupling means provided on the at least first pair of opposite sidewalls of the panel, so that the panel can be coupled to the locking member by a movement of at least one sidewall of the first pair of opposite sidewalls of the panel relative to said locking member, said movement being oriented in a direction substantially perpendicular to a plane of the panel, and towards the locking member. Such coupling means are particularly advantageous since they can be assembled gradually, for example by tapping along the to be joint length of the panels. Preferably, the coupling means of the panel and the complementary coupling means provided on the locking member are substantially performed as a male coupling element and a female coupling element respectively, which, once coupled, provide a locking effect in at least a direction perpendicular to the plane of the panel, and in a direction perpendicular to the respective sidewalls and in the plane of the panel. Such a connection is better known by the denomination of "push-lock".

Preferably said locking member is an element separate from the panel and/or a potential supporting structure.

In various embodiments, the locking member comprises preferably between 2 and 10 locking members, along at least a sidewall of the panel, in a coupled condition.

The locking member can be attached to a wall or a supporting structure before a first panel has been coupled to the locking member, or after a first has been coupled to the locking member.

In a preferred variant, a locking member is first coupled to a first panel before the locking member is attached to the wall or supporting structure. Subsequently, the panel and the locking member are applied onto the wall or supporting structure and the locking member is attached onto the wall or supporting structure. This provides for the locking member to be substantially perfectly aligned before it is attached to the wall, which in turn will ease the installation and ensure the alignment of a second panel to be attached to the same locking member.

In various embodiments, the locking member is attached to the wall or ceiling by means of an adhesive connection such as glue or tape.

In another variant, the attachment of the locking member to the wall or supporting structure is done before the locking member is coupled to a first panel. In such case, it is recommended that the attachment of the locking member to the wall or supporting structure allows for some play in a plane of the wall or supporting structure, in order to compensate any misplacement or misalignment of the locking member. It appears clearly that once a first panel has been attached to the respective locking member, movements of the locking member will be restricted, which in turn will ease the installation and ensure the alignment of a second panel to be attached to the same locking member.

In various embodiments, the locking member is attached to the wall or ceiling by means of a mechanical connection such as at least one nail or screw and the locking member is provided with means to allow it to slide once attached to the wall. Such means can comprise for example at least a slot into which the at least one nail or screw will be located. The slot being slightly bigger than the at least one nail or screw, thus allowing movement of the locking member in relation to the wall or supporting structure to which it is attached. In such case, the slot is preferably substantially perpendicular to the sidewall to which the locking member will be coupled. In other words, where the locking member is attached onto a wall along a vertical line, the slots are preferably perpendicular to said vertical line.

In various embodiments, the locking member comprises complementary coupling means, complementary to the coupling means of the panel, on two opposite sides of the locking member. This provides for the locking member to have a plane of symmetry and eases installation in that the installers do not need to be concerned by the orientation of the locking member, as long as the coupling means of the panels are aligned with the complementary coupling means of the locking member.

In various embodiments, the coupling means on the at least two opposites sidewalls of the panel are substantially identical. Having substantially identical coupling means on at least two opposites sidewalls of the panel can substantially ease the installation in that it is not necessary to pay attention to the orientation of the panel. When a locking member is provided, and the locking member comprises identical complementary coupling means on two opposite sides of the locking member, any of the coupling means located on the sidewalls of a panel can be coupled with any of the complementary coupling means of the locking member.

In a variant of the locking member, the cross-section of the locking member can be substantially L-shape and the locking member can be used in a corner, e.g. in an angle between two adjacent walls. In another variant, the locking member comprises only one complementary coupling means (e.g. on one side of the locking member) and is attached to only one panel.

In a preferred embodiments, the locking member is no longer visible after panels have been coupled with the locking member. Alternatively, the locking member can be provided with an upper face that comprises or forms a décor. Preferably, the appearance of the décor of the locking member substantially matches the decorative layer of the panels. This can prove very convenient when the locking member is used in a corner, e.g. in an angle between two adjacent walls, in particular in an external angle.

In various embodiments, at least a sidewall of the panel is longer than 1600 mm.

In some embodiments the panel further comprises coupling means on a second pair of opposites sidewalls so that any of the first pair or second pair of opposite sidewalls can be coupled to one or more locking member, further allowing to obtain a visually seamless joint with an adjacent panel on any of the sidewalls of the panel.

In various embodiments, the coupling means on the second pair of opposites sidewalls, and the coupling means on the first pair of opposite sidewalls are substantially identical. This provides for the panel to have identical coupling means on at least four sidewalls, and that the same type of locking member, provided with complementary coupling means, can be used on any of the at least four sidewalls indifferently. This configuration of the coupling means can reduce production costs in that less tooling is required for producing the panels according to this particular embodiment of the invention. For instance, only one type of milling tool is required to mill all sidewalls of the panel.

According to yet another embodiment, a set of panels for forming a wall or ceiling panel assembly in accordance with the first aspect and/or the preferred embodiments thereof is provided, wherein the set of panels comprises at least two panels.

According to a fourth independent aspect of the invention, there is provided a wall or ceiling panel assembly comprising at least a first panel of a substantially rectangular or oblong shape, the panel having a front side and a back side and comprising at least a base layer and a decorative layer, wherein the decorative layer is applied on the side of the base layer directed to the front side of the panel, and attachment means on the back side of the panel, thereby providing new possibilities for attaching the panels to a wall or a ceiling, in particular releasable connections between the panels and the wall or ceiling.

The wall or ceiling panel assembly further comprises resilient locking member operative to cooperate with the attachment means, thus resulting in a connected condition of the panel with said resilient locking member. Providing a resilient locking member is advantageous in that the connection of the attachment means with the resilient locking member allows for relative movement between the resilient locking member and the panel and thus cope with expansion or contraction of the panels such as occur with temperature variations.

Preferably such resilient locking member is a separate element from the panel and/or a potential supporting structure.

In preferred embodiments, the panel further comprises a tongue on at least a first sidewall of the panel, a groove in a sidewall opposite to the first sidewall, said tongue and said groove being configured such that two of such panels can be coupled to each other in a plane of the first panel, ie with minimal height differences between the two panels surfaces.

In various embodiments, the wall or ceiling panel assembly further comprises at least a second panel similar to the first panel, a tongue of the second panel being coupled with a groove of the first panel, said tongue being allowed to slide freely within said groove.

In particular, the tongue and groove coupling according to the above mentioned embodiments of the invention provides no locking of the first and second panels in a plane substantially parallel to the plane of the panels. The free sliding of the tongue within the groove allows for small movements (e.g. in the order of a few millimetres) in the plane of the panels that result, for example, from expansion or contraction of the panels as a consequence of temperature variations.

In preferred embodiments, the resilient locking member deform upon connection with the attachment means and substantially recover their original shape in the connected condition. Providing locking member that can be deformed also proves advantageous in that it also allows for small movements of the panels such as expansion or contraction.

In various embodiments, the attachment means can be connected to the resilient locking member by a movement of the panel relative to said resilient locking member, said movement being oriented towards the resilient locking member, and in a direction substantially parallel to the panel, or in a direction substantially perpendicular to the panel.

In various embodiments, once the tongue and groove connection has been set, inducing a movement in a direction substantially parallel to the panel (i.e. parallel to the plane of the panel) can set the connection between the resilient locking member and the attachment means. According to a particular embodiment, the resilient locking member acts substantially like a fish hook and can lock with the attachment means when the attachment means is in the close vicinity of the resilient locking member. As the back side of panel exerts a pressure on the resilient locking member, the resilient locking member deforms thanks to its inherent elasticity. The configuration of the attachment means is such that the resilient locking member can recover its neutral shape, or a shape closer to its neutral shape, when the locking of the attachment means and the resilient locking member has occurred.

Alternatively, after the tongue and groove connection of the panel has been set, applying pressure on the panel can lock the resilient locking member with the attachment means. In this variant, the resilient locking member has a shape that allows it to be locked with the attachment means via a movement perpendicular to the panel (i.e. perpendicular to the plane of the panel). Such shape can preferably be a shape where the resilient locking member protrudes from a surface (e.g. a wall or a supporting structure), and where the distal end of the resilient locking member is bigger than the proximal end of the resilient locking member. This can include a conical shape, or a mushroom-like shape, for example. The distal end of the resilient locking member interacts with the attachment means of the panel and can deform when a pressure is applied onto it, forcing it's way inside the attachment means. The portion of the attachment means that is closer to the backside of the panel is slightly smaller than the bigger portion of the resilient locking member, so that a deformation of the resilient locking member occurs when the panel is applied onto the resilient locking member. The deformation of the resilient locking member is such that, at some point, the size of the bigger portion of the resilient locking member has slightly decreased and subsequently the resilient locking member can find its way through the back side of the panel, and locks with the attachment means.

In various embodiments, the attachment means is a groove extending along a long side of the panel. Preferably, the groove is located on the back side of the panel. These embodiments are particularly advantageous in that they can be obtained by adding steps in the manufacturing process of panels. In particular, grooves can be obtained as part of an extrusion process, or milled afterwards in the same step as the milling of the tongue and groove which form the coupling means of the panels.

In a preferred embodiment, the resilient locking member comprises a polymer.

In another preferred embodiment, the resilient locking member comprises metal. Any metal provided with sufficient elasticity can be suitable. Preferably, aluminium or stainless steel is used in the locking member. It is preferable that the metal part of the resilient locking member does not come into direct contact with the attachment means, so that the resilient locking member does not damage the attachment means. Alternatively, the portion of the resilient locking member that comes into contact with the attachment means has a shape that reduces the risks of damage, such as a rounded shape or a shape at least partially complementary to the attachment means. Alternatively, the portion of the resilient locking member that comes into contact with the attachment means can be covered with a softer material such as a polymer. The metal-based resilient locking member behaves substantially like a spring.

In any case, the resilient locking member can advantageously be reused, so that the panels can be removed, for example for maintenance purpose (as mere example, a plumbing/pipework or cables/wires hidden behind the panels could easily be accessed without permanent damage to the wall of ceiling panel assembly since the panels can easily be removed and put back into place).

According to a particular embodiment, a wall or ceiling panel assembly is provided where the wall or ceiling panel assembly comprises at least a first panel of a substantially rectangular or oblong shape, the panel having a front side and a back side and comprising at least a base layer and a decorative layer, wherein the decorative layer is applied on the side of the base layer directed to the front side of the panel, a tongue on at least a first sidewall of the panel, a groove in a sidewall opposite to the first sidewall, said tongue and said groove being configured such that two of such panels can be coupled to each other in a plane of the first panel wherein the wall or ceiling panel assembly further comprises at least a second panel similar to the first panel, a tongue of the second panel being coupled with a groove of the first panel, said tongue being allowed to slide freely within said groove. The sliding of the tongue within the groove allows for movement of adjacent panels relative to each other, such as occur during expansion or contraction of the panels.

In preferred embodiments, the groove in the opposite sidewall defines an upper edge of the groove located closer to the front side of the panel, and a lower edge of the groove located closer to the back side of the panel, the decorative layer extending at least partially to an upper face of the tongue on the first sidewall, and to at least the upper edge of the groove. The decorative layer thus extends substantially over the whole front face of the panel.

Advantageously, a combination of the sliding tongue and groove coupling and the above mentioned decorative layer extending substantially over the whole front face of the panel provides a synergistic effect in that a visually seamless coupling of two adjacent (e.g. successive) panels is obtained. In particular, there is no visible gap between the decorative layers of each adjacent panel in the event of relative movement between the panels.

In various embodiments, the resilient locking member define a supporting structure to attach the panels to. The resilient locking member can be set in a grid-like arrangement so that they define a substantially flat surface onto which the panels can be attached. The resilient locking member can either be integral with the wall or the supporting structure, or be attached to the wall or the supporting structure.

According to yet another embodiment, a set of panels for forming a wall or ceiling panel assembly in accordance with the fourth aspect and/or the preferred embodiments thereof is provided, wherein the set of panels comprises at least two panels.

According to a fifth independent aspect of the invention, there is provided a transition panel comprising two plate-shape sections having a rectangular or oblong shape, each plate-shape section comprising at least a base layer on a back side, at least a decorative layer and a wear layer on a front side, coupling means on at least a first sidewall, and complementary coupling means on a second sidewall opposite to the first sidewall, wherein the plate-shape sections extend perpendicularly to each other, with their respective normal directions being substantially perpendicular to each other so that the transition panel is substantially L-shaped. The transition panel provides for a seamless transition between of a floor covering and a wall covering with the same product, more generally a seamless transition between adjacent surfaces having an angle between them. It is however not excluded that the plate-shape sections can form an angle which is not substantially perpendicular.

According to preferred embodiments, the two substantially perpendicular plate-shape sections are formed monolithically with each other, this provides for a homogeneous material across the whole panel. It also allows to obtain a transition panel from a flat panel, by folding (e.g. bending) said flat panel to a substantially perpendicular angle.

As appears clearly from the above, in a preferred embodiment, the transition panel is a folded panel. Accordingly, the transition panel can be obtained from a folded floor panel. One such floor-panel-based transition panel can be provided with at least one groove in the back side, in the direction of the front side, and subsequently folded (e.g. bent). At least the wear layer and the decorative layer are bent at the location of the tip of the groove. The deeper the groove is, the easier the folding (e.g. bending) will be, also thereby limiting the stress on the wear layer and decorative layer. However, the groove should not be so deep that it reaches the decorative layer, so that the décor remains uninterrupted to provide the seamless appearance of the transition panel.

Thus, according to a preferred embodiment at least the decorative layer and the wear layer of the transition panel are uninterrupted. As already mentioned, such configuration provides for an uninterrupted décor when transitioning from, for example, a floor to a wall at an approximately perpendicular angle. One advantage of such configuration is that the décor on the two adjacent plate shape sections will have the same appearance and that even embossments which may be present on the front side (typically on the wear layer) remain seamless as well.

As a matter of fact, providing the transition panels from folded floor panels provides further advantages, among which ease of transport, in that the panels can be packaged and transported in a flat configuration, and then only folded (e.g. bent) during installation in-situ. Alternatively, transition panels can also be obtained by machining the above-mentioned groove with the adequate tooling and fold the panels also in-situ.

In various embodiments an area of one of the two plate-shape sections is substantially the same as the area of the other plate-shape section.

In other various embodiments, an area of one of the two plate-shape sections is more than two times greater than the area of the other plate-shape section, more preferably about 3 times greater than the area of the other plate-shape section.

As will be explained further, providing transition panels having different plate-shape sections areas will give the opportunity to combine the transition panels with conventional flooring panels, where two adjacent flooring panels are typically installed with an offset in their longitudinal direction.

In various embodiments, a transition panel assembly is provided, the transition panel assembly comprising at least a first transition panel and a second transition panel, said first transition panel and second transition panel being provided according to any combination of the various embodiments of the sixth aspect, the coupling means of the first transition panel being complementary with the complementary coupling means of the second transition panel, and vice-versa.

In various embodiments, a transition panel assembly is provided where the coupling means of the first transition panel is coupled with the complementary coupling means of the second transition panel, and wherein the plate-shape sections of the first transition panel are substantially flush with the plate-shape sections of the second transition panel.

Preferably the edges of the transition panels comprised in a transition panel assembly at least allow a connection by means of a shifting motion of two such transition panels towards each other in the plane of the panels and/or perpendicular to the plane of the panels.

In preferred embodiments, a transition panel assembly is provided where two substantially flush plate shape sections have different areas. These two substantially flush plate shape sections each belong respectively to a first transition panel and a second transition, the transition panels being adjacent transition panels coupled to each other. Advantageously, this configuration provides a better aesthetic, in that the third and fourth sidewalls of the first transition panel are not aligned with either the third or fourth sidewall of the second transition panel.

According to yet another embodiment, a set of transition panels for forming a transition panel assembly in accordance with the sixth aspect and/or the preferred embodiments thereof is provided, wherein the set of transition panels comprises at least two transition panels.

Preferred embodiments of any of the previously described aspects and/or their preferred embodiments are described below.

In preferred embodiments, the composition of the base layer comprises a mineral-based filler. Examples of appropriate mineral-based fillers for the base layer comprise calcium carbonate-containing minerals such as chalk, but also fly ash or magnesium oxide. The presence of mineral fillers in the base layer improves the density and strength of the mixture. Other physical and chemical characteristics of the base layer can also be tuned as appropriate thanks to mineral fillers, such as flame retardancy, moisture resistance or abrasion resistance. Alternatively, talc (hydrous magnesium silicate) can also be used. It is not excluded that a mineral filler comprising a mix of different mineral fillers is used. The base layer can be obtained by an extrusion process or by strewing granulates in layer and melt the layer.

In preferred embodiments, the content of mineral-based filler is above 40% in weight of the base layer, more preferably above 60% in weight. Such filler contents ensure a cost-efficient end product with good mechanical characteristics.

In preferred embodiments the composition of the base layer comprises a thermoplastic polymer. Almost any kind of polymer could be used, such as, but not limited to polyvinyl chloride (PVC), polyethylene (PE), polyethylene terephthalate (PET), polypropylene (PP), or polyurethane (PU), as is widely available on the market. Preferably, the thermoplastic polymer comprises polyvinyl chloride (PVC). The problem of bending is especially prevalent with this type of panels. Moreover these materials are waterproof and provide a protection against moisture, thus being adapted also for a use in wet rooms (e.g. kitchen, bathroom . . . etc).

In preferred embodiments, the density of the base layer is greater than 1500 $kg/m^3$.

In preferred embodiments, the thickness of the panel is lower than 7 mm. Panels having a low thickness combined with a great width (in an example where the width of the panel is at least 200 mm, the width is more than 28 times greater than the thickness) and an even greater length (in an example where the length of the same panel is greater than 1200 mm, the length is at least 171 times greater than the thickness) tend to bend or arch very easily as their area moment of inertia, is much lower about an axis X that is parallel to the width of the panel, than about an axis Y that is perpendicular to the plane of the panel. For example, the area moment of inertia about an axis parallel to the width would be $I_x=7^3*200/12=5\ 716\ mm^4$, whereas the area moment of inertia about an axis that is perpendicular to the plane of the panel of the example would be $I_y=7*200^3/12=466\ 666\ mm^4$. The very low area moment of inertia $I_x$ influences to a great extent the bending stiffness (also known as "flexural rigidity") of the panel. Since the bending stiffness of the panel is a function of the Young's modulus E and of the area moment of inertia I of the beam's cross-section about the axis of interest (in our example $I_x$). It appears clearly that a base layer having a low Young's modulus, as is the case with PVC, combined with a low area moment of inertia along a specific direction does greatly reduce the bending stiffness of the panel. The invention is of great interest to such panels.

In various embodiments, the coupling means is embodied as a male coupling element and the complementary coupling means as a female coupling element. Alternatively, the coupling means can be embodied as a female coupling element and the complementary coupling means as a male coupling element.

In various embodiments, the couplings means and the complementary coupling means are substantially identical and are complementary when one of them is used upside down.

According to a sixth independent aspect of the invention, there is provided a covering for a wall or ceiling, the covering being substantially rectangular or oblong and comprising at least a base layer, and a top layer, the top layer comprising at least a decorative layer, said decorative layer being provided on a thermoplastic foil, and wherein said covering is provided in the form or a roll.

In various embodiments, the covering preferably has a maximum thickness of 3 mm or a maximum thickness of 2 mm. Such low thickness keeps the covering flexible, thereby also allowing to provide the covering in a roll. Preferably the thickness is larger than 0.5 millimeter.

In various embodiments, the top layer further comprises a wear layer, said wear layer having a thickness of 0.2 mm or less. The wear layer provides protection against scratches and indentation on the panel, as well as for a medium to form embossments or other textures, for example embossments enhancing the realism to the pattern comprised in the decorative layer. The limited thickness maintains a good visibility of the decorative layer without creating a plastic-like impression. Further, the limited thickness of the wear layer maintains the fluent manipulation of the wall covering prior to and during installation, since it limits the weight of the covering.

In various embodiments, the wear layer is provided with a texture. The texture can be any texture such as for example wood grain or a cement-looking relief.

Preferably, the texture provided on the wear layer matches the décor of the decorative layer, in an embossed-in-register manner.

In various embodiments, the texture is embossed directly in the wear layer. Embossing the wear layer can be achieved in a press or via rollers applied onto the wear layer during a manufacturing step of the covering.

In various embodiments, the base layer comprises foam. Adding foam in the base layer will make it lighter and thus easier to handle and transport. Foam is obtained by adding blowing agents that produce a cellular structure via a foaming process in polymers that undergo hardening or phase transition. The foam comprised in the base layer reduces density, increases thermal and acoustic insulation, and also increases the stiffness of the base layer.

In various embodiments, the thermoplastic foil has a thickness from 40 to 100 microns, preferably from 70 to 90 microns.

In various embodiments, a width of the covering is about 1 m.

Preferably the base layer of the covering comprises a carrier layer such as a glass fiber layer, or a layer of polymer fibers, such as polyamide fibers. The fiber layer may be a woven or non-woven textile layer, preferably of glass fibers.

In various embodiments, the covering is attached to a wall by means of an adhesive. Preferably, the adhesive used to attach the covering to a wall is a glue. Alternatively, or in combination with glue, an adhesive tape could be used. Glues gives the opportunity for adjusting slightly the covering onto the wall, e.g. before the glue cures, whereas adhesive tape do not need to allow for curing time, so that a combination of both glue and adhesive tape can prove useful depending on the covering installation step.

In preferred embodiments, the composition of the base layer comprises a mineral-based filler. Examples of appropriate mineral-based fillers for the base layer comprise calcium carbonate-containing minerals such as chalk, but also fly ash or magnesium oxide. The presence of mineral fillers in the base layer improves the density and strength of the mixture. Other physical and chemical characteristics of the base layer can also be tuned as appropriate thanks to mineral fillers, such as flame retardancy, moisture resistance or abrasion resistance. Alternatively, talc (hydrous magnesium silicate) can also be used. It is not excluded that a mineral filler comprising a mix of different mineral fillers is used. The base layer can be obtained by calendaring process in which e.g. a PVC plastisol is provided on a carrier layer, such as a glass fiber layer. In accordance with variants, the base layer can be obtained by an extrusion process or by strewing granulates in layer and melt the layer.

In preferred embodiments, the content of mineral-based filler is above 40% in weight of the base layer, more preferably above 60% in weight. Such filler contents ensure a cost-efficient end product with good mechanical characteristics.

In preferred embodiments, the composition of the base layer comprises a thermoplastic polymer. Almost any kind of polymer could be used, such as, but not limited to polyvinyl chloride (PVC), polyethylene (PE), polyethylene terephthalate (PET), polypropylene (PP), or polyurethane (PU), as is widely available on the market. Preferably, the thermoplastic polymer comprises polyvinyl chloride (PVC). The problem of bending is especially prevalent with this type of panels. Moreover these materials are waterproof and provide a protection against moisture, thus being adapted also for a use in wet rooms (e.g. kitchen, bathroom . . . etc).

In various embodiments, the density of the base layer is 1000 kg/m$^3$ or less.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF VARIOUS EMBODIMENTS

Figure 1:
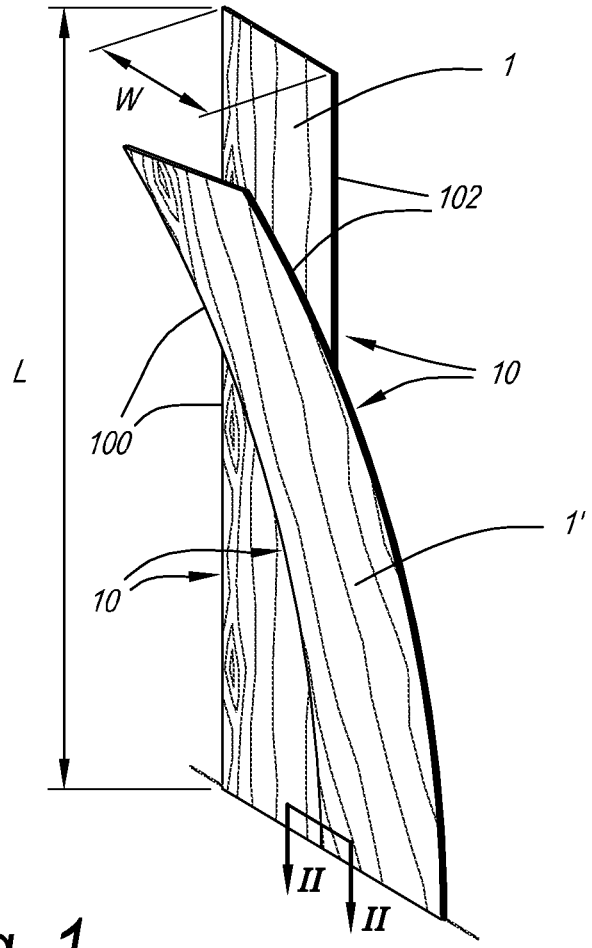
FIG. 1 is a perspective view of a wall panel assembly during installation.

FIG. 1 shows a wall panel assembly. The wall or ceiling panel assembly comprises a first panel 1 and a second panel 1' of rectangular or oblong shape. Each panel is provided with coupling means 100, 102 on at least two opposite long sidewalls 10. As can be seen, the second panel 1' as a low thickness and tends to bend or arch easily. This may for example be the case with LVT, SPC or WPC.

Figure 2:
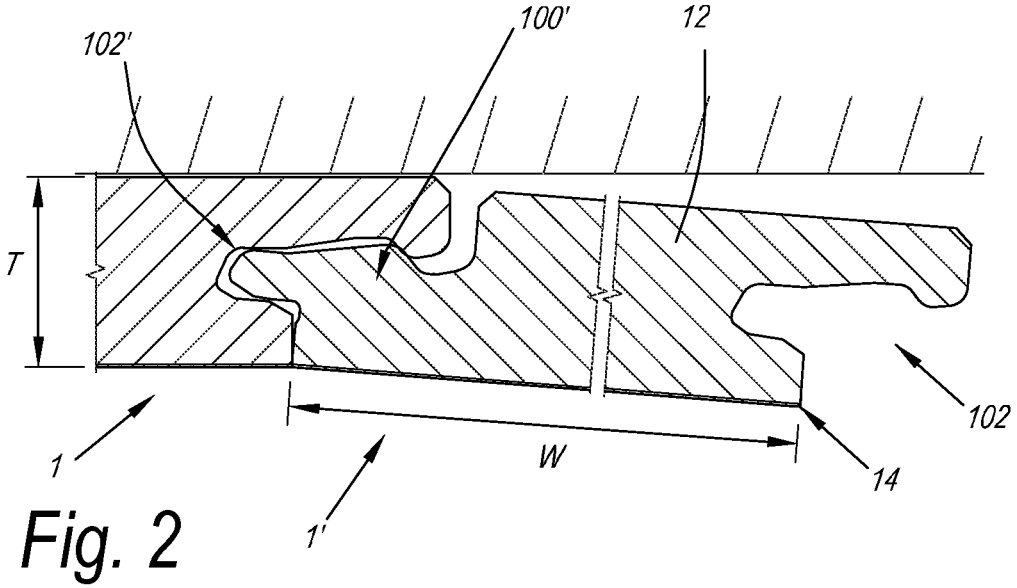
FIG. 2, in a cross-section according to the line II-II represented in FIG. 1, is an enlarged section view of the coupling means of FIG. 1.

FIG. 2 is an enlarged section view of a first example of the coupling means 100, 102 for the assembly of FIG. 1. The couplings means 100, 102 are male and female coupling elements. In particular the male and female coupling elements are a tongue 100' and a groove 102' respectively. For such connection to be effected along the whole length of the panels, it is necessary that the panels be brought substantially parallel to each other, in particular substantially flat, in order to insert the tongue 100' of a second panel 1' into the groove 102' of the first panel 1 over the whole length of the panels. This is practical for example with panels having a length of 1200 mm or less.

Figure 3:
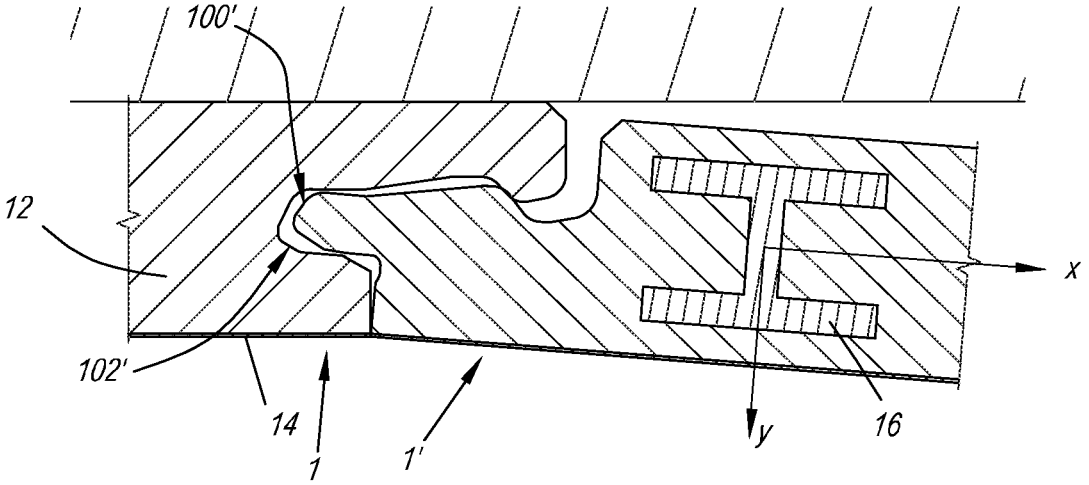
FIGS. 3 to 5 in the same view as FIG. 2 show variants.

FIG. 3 represents a wall or ceiling assembly similar to the panels of FIGS. 1 and 2. The panels comprise at least a base layer 12 that includes a mineral-based filler, and a decorative layer 14 on top of the base layer 12. The panels of FIG. 3 however further comprise a stiffening member 16 adjacent to one of the long sidewalls 10 of the panels. The stiffening member 16 increases the rigidity of the panels, thus rendering the connection of the couplings means 100, 102 easier, in that the tongue 100' and groove 102' are substantially automatically aligned, thus facilitating the insertion of the tongue 100' of the second panel 1' in the groove 102' of the first panel 1 along the whole length of the panels. The stiffening member 16 in this example is an I shape beam fully embedded in the base layer 12 of the panel. The I-shape beam has a high area moment of inertia about the axis x, thereby acting against the bending of the panel. Providing a stiffening member 16 based on a material having a higher Young's modulus than the base material of the panel consequently increases the rigidity of the panel.

Based on the rigidity requirements of the panel, the stiffening member 16 can comprise either a thermoplastic polymer, or metal, or a combination thereof.

In the present example, the width W of the panel is greater than 200 millimetres and the thickness T is lower than 7 mm. The base layer 12 of the panels comprises a thermoplastic polymer and, as already mentioned, a mineral-based filler, in a proportion of preferably above 40% in weight of the base layer 12, more preferably above 60% in weight. The density of the base layer 12 is greater than 1500 kg/m3

When the stiffening member 16 comprises a thermoplastic polymer, said thermoplastic polymer should have a Young's modulus at least one and a half times greater than the Young's modulus of the thermoplastic polymer of the base layer 12.

The embodiment of FIG. 3 is practical for panels with any length, for example with panels having a length of greater than 1200 mm.

Figure 4:
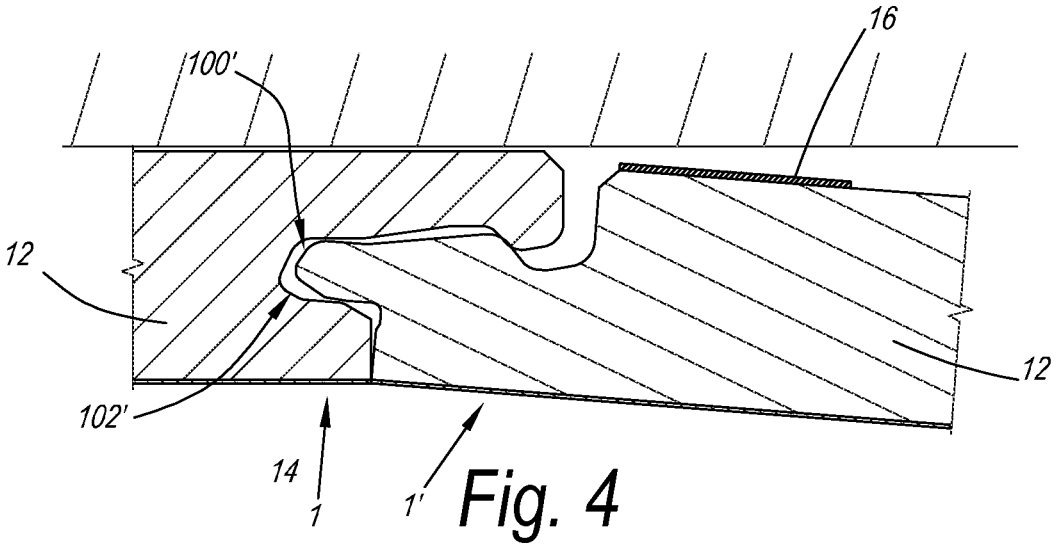

FIG. 4 represents a variant of the stiffening member 16 where the stiffening member 16 is adhered or otherwise attached to the base layer 12 of a second panel 1'. In this particular example, the stiffening member 16 is attached to the back side of the base layer 12.

Figure 5:
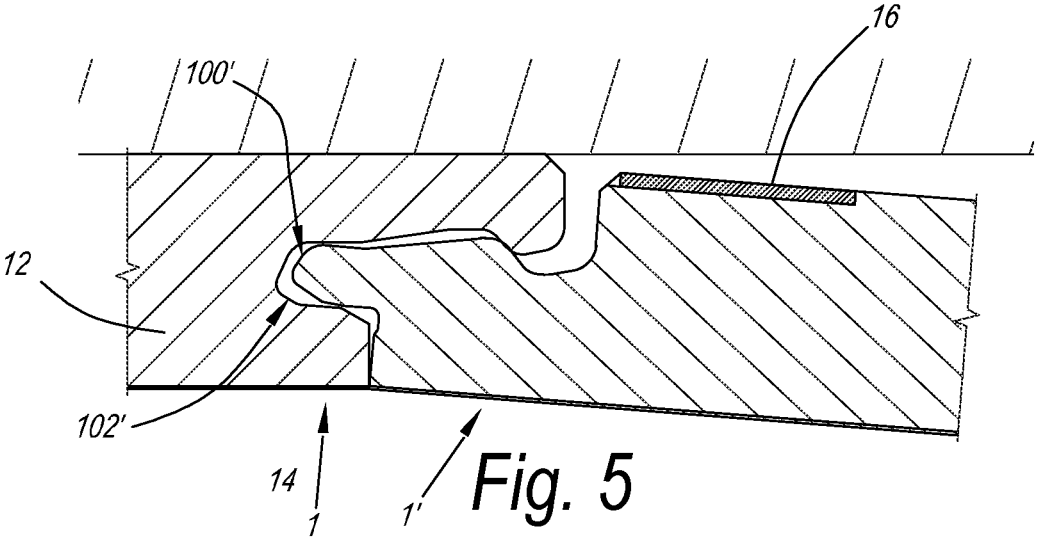

FIG. 5 represents another variant where the stiffening member 16 is at least partially embedded into the panel 1' and located adjacent to the tongue 100' (e.g. male coupling element).

Figure 6:
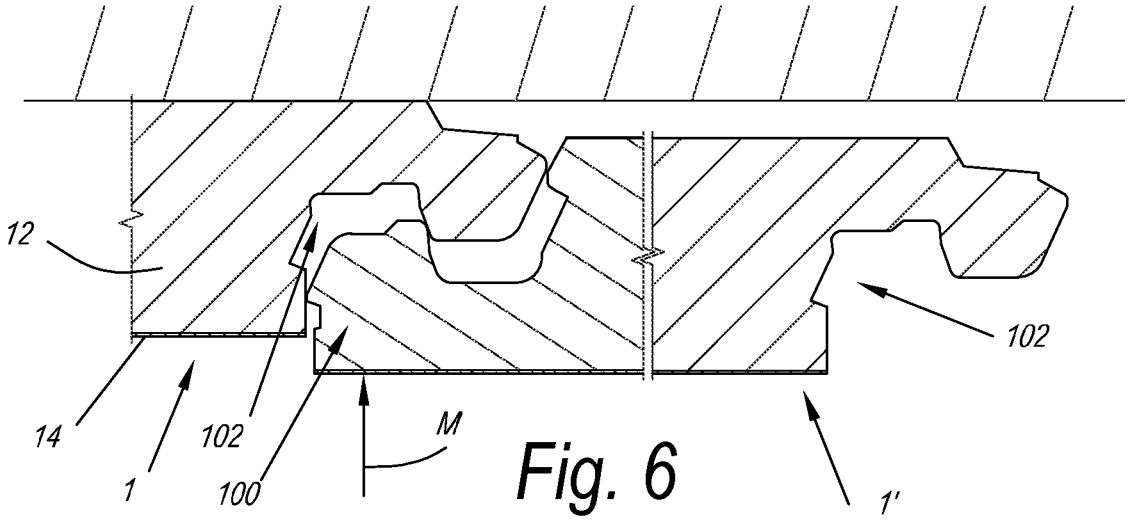
FIG. 6 in the same view shows the couplings means of an embodiment of the second aspect of the invention.

FIG. 6 shows an enlarged section view of the couplings means of an embodiment of a wall panel assembly according to the second aspect of the invention. The wall panel assembly comprises a first panel 1 of a substantially rectangular or oblong shape and comprising at least a base layer 12 and a decorative layer 14. The panel is provided also with coupling means 100, 102 that are complementary to each other on at least a pair of opposite sidewalls 10 of the panel 1. A second panel 1' is provided and is substantially similar to the first panel 1, so that the coupling means 100, 102 are configured such that two of such panels can be coupled to each other in a plane of the panel by a movement M of the coupling means 100 of the second panel 1', relative to the complementary coupling means 102 of the second panel 1', in a direction substantially perpendicular to a plane of the panels, and towards the complementary coupling means 102 of the first panel 1.

In the present example, the length L of each panel is greater than 1600 mm, the width W of the panel is greater than 200 millimetres and the thickness T is lower than 7 mm. The base layer of the panels comprises a thermoplastic polymer and, as already mentioned, a mineral-based filler, in a proportion of preferably above 40% in weight of the base layer, more preferably above 60% in weight. The density of the base layer is greater than 1500 kg/m3

Figure 7:
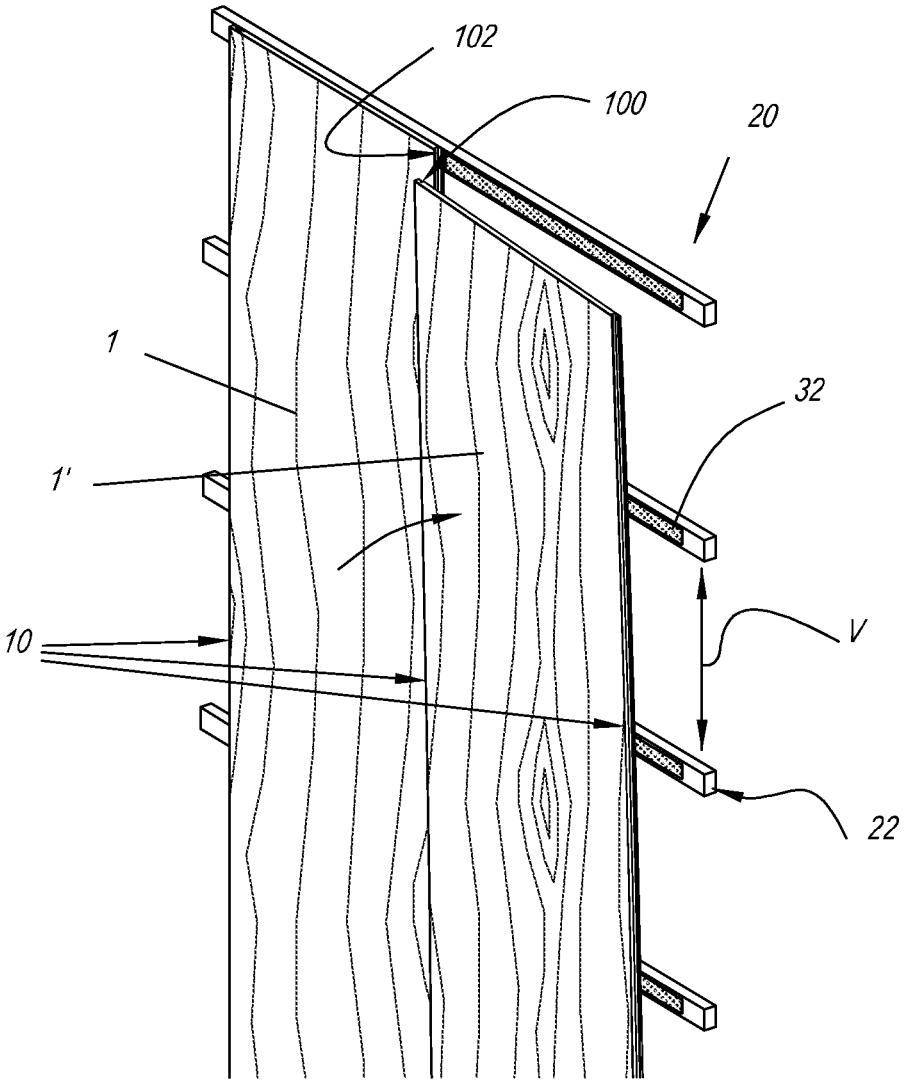
FIG. 7 in a similar view as FIG. 1 represents a wall panel assembly according to the second aspect of the invention.

FIG. 7 shows a wall panel assembly with a supporting structure 20 comprising elongated members 22 running substantially parallel to the wall or ceiling. The distance V between two neighbouring elongated members 22 is preferably smaller than 400 mm, more preferably smaller than 250 mm. The panels can be attached onto the supporting structure 20 by means of reusable means 32 such as a hook-and-loop. Alternatively, panels can be attached onto the supporting structure 20 by means an adhesive.

Figure 8:
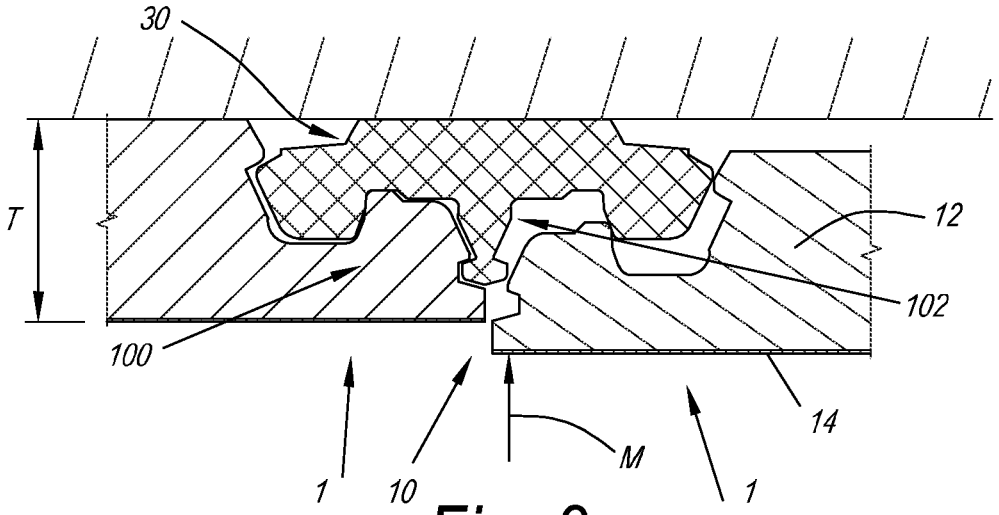
FIG. 8 is an enlarged section view of the coupling means according to the third aspect of the invention.

FIG. 8 represents an enlarged section view a wall panel assembly according to the third aspect of the invention. The wall or ceiling panel assembly comprises at least a first panel 1 of a substantially rectangular or oblong shape provided with coupling means 100, 102 on at least a first pair of opposite sidewalls 10 of the panel, the panel further comprises at least a base layer 12 and a decorative layer 14. The wall or ceiling panel assembly further comprises a locking member 30 having complementary coupling means 102, said complementary coupling 102 means being complementary to the coupling means 100 provided on the at least first pair of opposite sidewalls 10 of the panel 1, so that the panel 1 can be coupled to the locking member 30 by a movement M of at least one sidewall 10 of the first pair of opposites sidewalls 10 of the panel relative to said locking member 30, in a direction substantially perpendicular to a plane of the panel, and towards the locking member 30.

Figure 9:
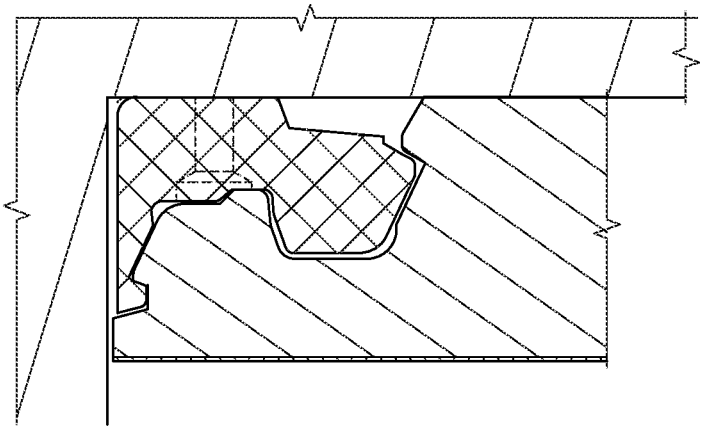
FIGS. 9 to 11 show an enlarged section view of variants of the locking member of the third aspect.

FIG. 9 shows an enlarged section view of a variant of the locking member 30 of the second aspect where the locking member 30 is used as a starting locking member, ie at one end of a wall where the wall assembly begins.

Figure 10:
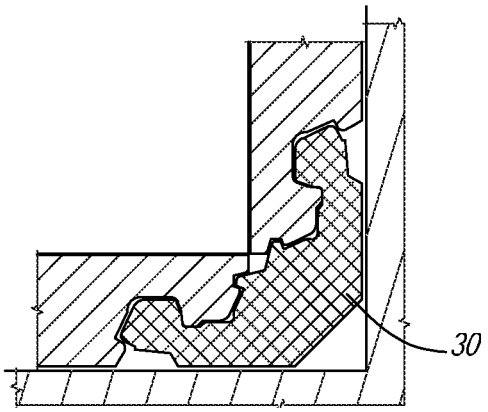

FIG. 10 shows an enlarged section view of a second variant of the locking member 30 as can be used on an inner angle (e.g. corner), at a junction between two walls. In this particular example, the two walls are substantially orthogonal.

Figure 11:
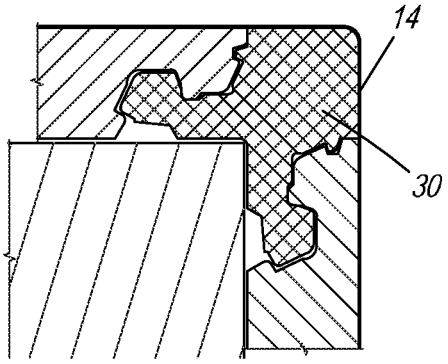

FIG. 11 shows an enlarged section view of a third variant of the locking member 30 as can be used on an outer angle (e.g. corner) of a wall. The locking member 30 is provided with a decorative layer 14 that matches the decorative layer 14 of the panels so that the décor appears visually seamless in this particular corner. Also in this example the two walls are substantially orthogonal.

Figure 12:
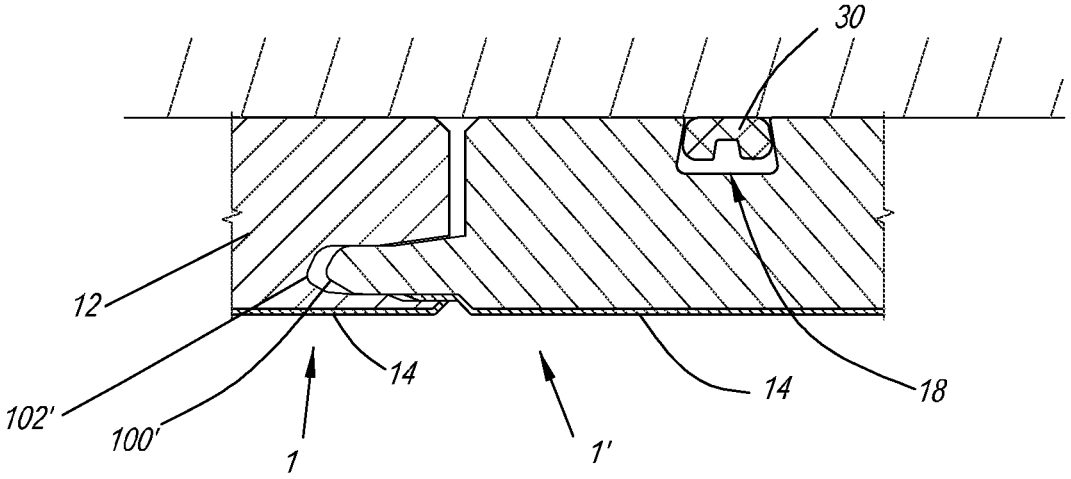
FIG. 12 shows an enlarged section view of the couplings means of an embodiment of the fourth aspect of the invention.

FIG. 12 shows an enlarged section view of the couplings means of an embodiment of the fourth aspect of the invention. The wall or ceiling panel assembly comprises a first panel 1 of a substantially rectangular or oblong shape, and having a front side and a back side. The panels further comprise a base layer 12 and a decorative layer 14, wherein the decorative layer 14 is applied on the side of the base layer 12 directed to the front side of the panel. Attachment means 18 are provided on the back side of the panel 1'.

The wall or ceiling panel assembly further comprises resilient locking member 30 which is attached to a wall, a ceiling, or a supporting structure. The resilient locking member 30 is operative to cooperate with the attachment means 18 in order to connect the panel with said resilient locking member 30. Once connected, the panel is then attached to the wall.

The resilient locking member 30 is deformable and deforms upon connection with the attachment means 18 and substantially recover its original shape in the connected condition. The resilient locking member 30 can be reused, but also allows for small relative movements between the panel and the wall, such as movements due to contraction or expansion of the panel.

The attachment means 18 can be connected to the resilient locking member 30 by a movement of the panel relative to said resilient locking member 30, oriented towards the locking member 30, and in a direction substantially perpendicular to the panel.

The panel comprises a tongue 100' on at least a first sidewall 10 of the panel and a groove 102' in a sidewall 10 opposite to the first sidewall 10. A second panel 1' similar to the first panel 1 is provided, the tongue 100' of the second panel being coupled with the groove 102' of the first panel 1, the tongue 100' and groove 102' are designed such that said tongue 100' is allowed to slide freely within the groove 102'.

Figure 13:
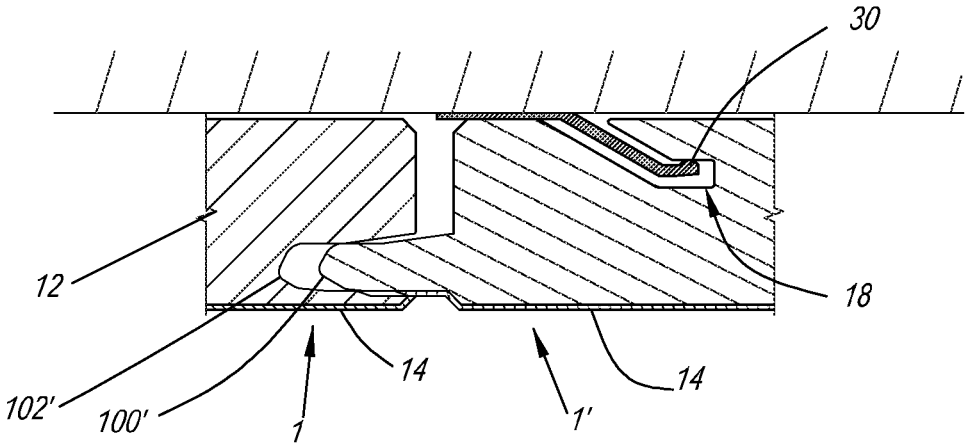
FIG. 13 shows an enlarged section view of the couplings means of an alternative embodiment of the fourth aspect of the invention.

FIG. 13 represents and alternative embodiment of the wall or ceiling panel assembly according to the fourth aspect. This embodiment is similar to the embodiment of FIG. 12 except that the resilient locking member 30 has a different configuration, in particular a configuration that resembles a fish hook. The attachment means 18 can be connected to the resilient locking member by a movement of the panel relative to said resilient locking member 30, said movement being oriented towards the resilient locking member 30, and in a direction substantially parallel to the panel.

The resilient locking member 30 can comprise a polymer, metal, or combination thereof.

In the embodiments according to FIGS. 12 and 13, the attachment means 18 is a groove extending along a long side of the panel.

Figure 14:
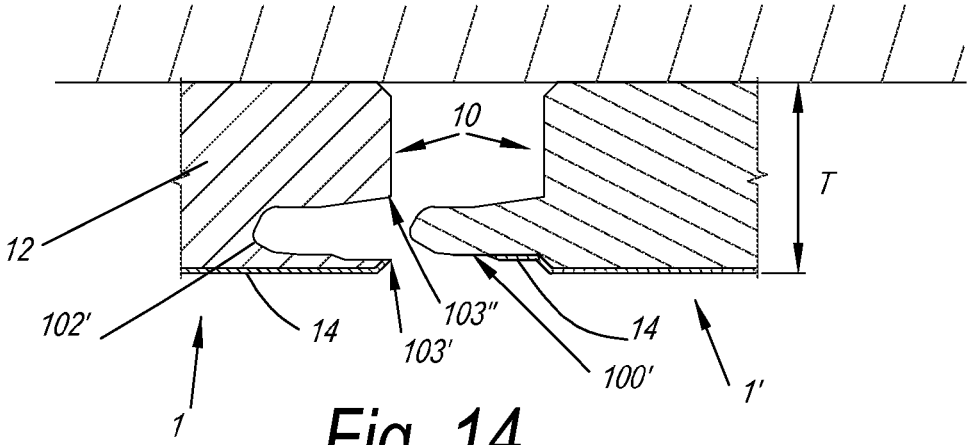
FIG. 14 shows an enlarged section view of the couplings means of another alternative embodiment of the fourth aspect of the invention.

FIG. 14 shows a wall or panel ceiling assembly similar to the wall or ceiling panel assembly of FIG. 12, but without locking member 30 and without attachment means 18. In this particular embodiment, the panels can be adhered onto the wall by reusable means such as hook and loop, by means of an adhesive, or by another suitable means.

In the wall or ceiling panel assembly according to FIGS. 12 to 14, the groove 102' in the opposite sidewall 10 defines an upper edge 103' of the groove located closer to the front side of the panel, and a lower edge 103" of the groove 102' located closer to the back side of the panel. The decorative layer 14 extends at least partially to an upper face of the tongue 100' and to at least the upper edge 103' of the groove 102'.

In these examples, the width W of the panel is greater than 200 millimetres and the thickness T is lower than 7 mm. The base layer 12 of the panels comprises a thermoplastic polymer and a mineral-based filler, in a proportion of preferably above 40% in weight of the base layer 12, more preferably above 60% in weight. The density of the base layer 12 is greater than 1500 kg/m$^3$ FIG. 15 and the details in FIG. 16 show a perspective view of transition panels 40 according to the fifth aspect of the invention, each transition panel 40 comprises two plate-shape sections 106 having a rectangular or oblong shape. Each plate-shape section comprises a base layer 12 on a back side, and a decorative layer 14 and a wear layer 15 on a front side. For each transition panel 40, coupling means 100 are provided on at least a first sidewall 10, and complementary coupling means 102 on a second sidewall 10, opposite to the first sidewall 10. the coupling means 100 of each transition panel 40 are complementary with the complementary coupling means 102 the other transition panels 40, and vice versa. The two plate-shape sections 106 of each transition panel 40 extend perpendicularly to each other, with their respective normal directions being substantially perpendicular to each other so that each transition panel 40 is substantially L-shaped.

The two plate-shape sections are formed monolithically with each other, in particular they have been obtained from a bended floor panel. A groove has been milled in the base layer 12 over the entire width W of the panel and the panel has been subsequently bent. Only the base layer 12 has been milled, thus ensuring that the decorative layer 14 and the wear layer 15 of the transition panel 40 are uninterrupted.

Figure 15:
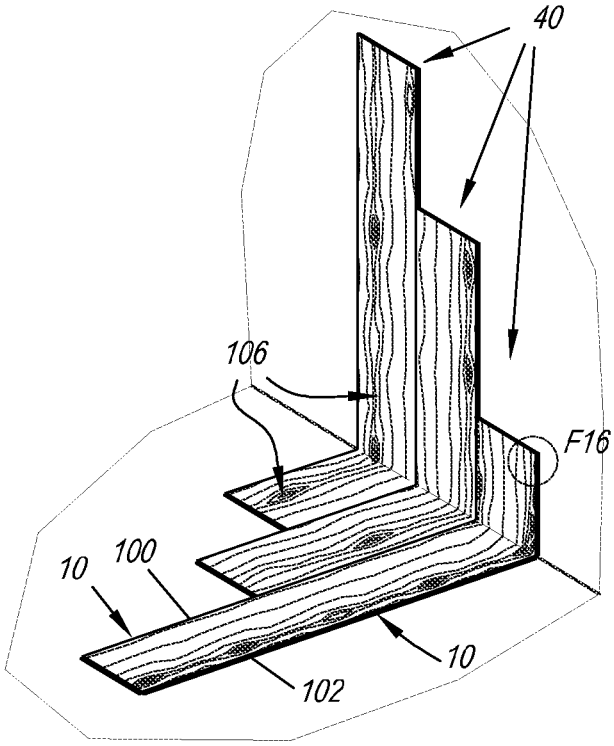
FIG. 15 shows a perspective view of a transition panel assembly according to the fifth aspect of the invention.
Figure 16:
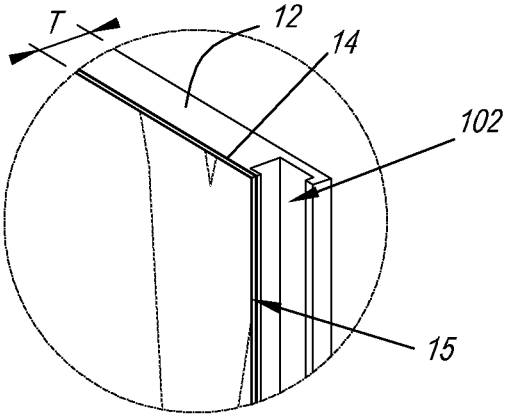
FIG. 16 represents an enlarged view of a detail of FIG. 15.

Various embodiments of transition panels 40 are shown on FIG. 15. At least one transition panel 40 has a plate-shape section's area that is more than two times greater than the area of the other plate-shape section 106 more preferably about 3 times greater than the area of the other plate-shape section 106. Another transition panel 40 comprises two plate-shape sections 106 which have substantially the same area.

In these examples, the width W of the transition panel 40 is greater than 200 millimetres and the thickness T is lower than 7 mm. The base layer 12 of the transition panels 40 comprise a thermoplastic polymer, and a mineral-based filler in a proportion of preferably above 40% in weight of the base layer 12, more preferably above 60% in weight of the base layer 12. The density of the base layer 12 is greater than 1500 kg/m$^3$.

FIG. 16 shows an enlarged view of a detail of FIG. 15. The base layer 12 is on a back side of the transition panel 40. A decorative layer 14 and a wear layer 15 are on a front side of the transition panel 40.

Figure 17:
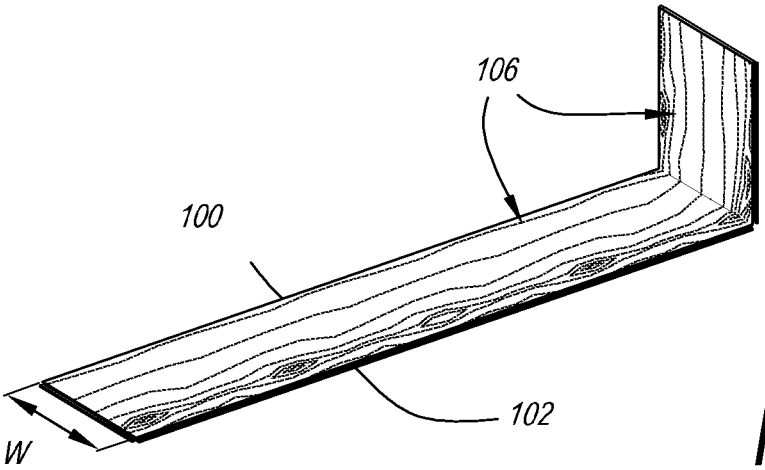
FIG. 17 shows a transition panel according to the fifth aspect of the invention.

FIG. 17 shows a perspective transition panel 40 according to a particular embodiment of the fifth aspect of the invention.

Figure 18:
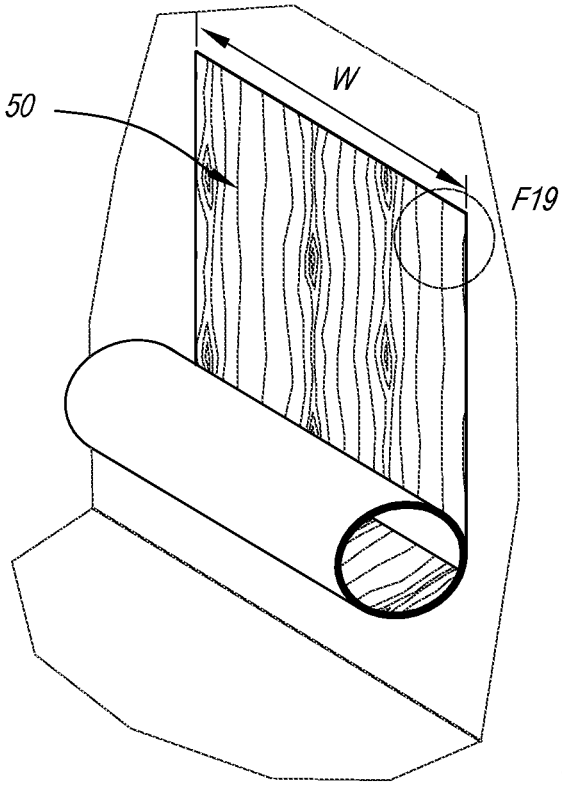
FIG. 18 is a perspective view of a wall covering according to the sixth independent aspect of the invention.

FIG. 18 is a perspective a wall or ceiling covering according to a sixth aspect of the invention. The width W of the covering 50 is about 1 m and is attached to a wall by means of an adhesive. The covering is provided in the form or a roll.

Figure 19:
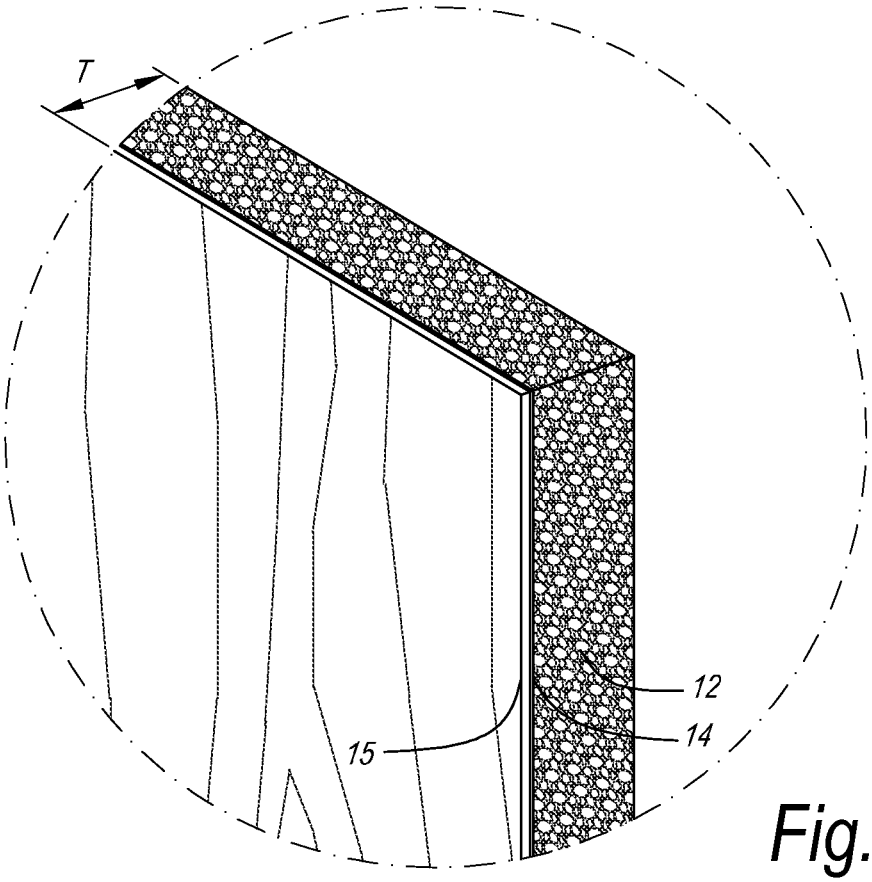
FIG. 19 represents an enlarged view of a detail of FIG. 18.

FIG. 19 is an enlarged section view of a detail of FIG. 18 where the covering 50 has a thickness T of 2 mm or less and is substantially rectangular or oblong. The covering 50 comprises a base layer 12 comprising foam, and a top layer comprising at least a decorative layer 14 and a wear layer 15. The composition of the base layer 12 comprises a thermoplastic material, and a mineral-based filler, preferably above 40% in weight, more preferably above 60% in weight. The density of the base layer 12 is 1000 kg/m$^3$ or less. The wear layer 15 is provided with a texture embossed directly in the wear layer 15 and has a thickness of 0.2 mm or less. The decorative layer 14 is provided on a thermoplastic foil which has a thickness from 40 to 100 microns, preferably from 70 to 90 microns.

The present invention is in no way limited to the herein above-described embodiments, on the contrary can such assemblies and panels be realized according to various variants, without leaving the scope of the present invention.

The invention claimed is:

1. A wall or ceiling panel assembly comprising:

at least one panel of rectangular or oblong shape provided with coupling means on at least two opposite long sidewalls of said panel, wherein a length of the panel is greater than 1200 mm, the panel comprising:

at least a base layer comprising a mineral-based filler, and a decorative layer on top of the base layer, a coupling means on at least one long sidewall and a complementary coupling means on the opposite long sidewall, wherein the panel further comprises a stiffening member adjacent to one of the long sidewalls;

wherein the suffering member is located within a distance of one-third of a width of the panel.

2. The wall or ceiling panel assembly according to claim 1, wherein the width of the panel is greater than 200 millimeters.

3. The wall or ceiling panel assembly according to claim 1, wherein a composition of the base layer comprises a thermoplastic polymer, wherein the thermoplastic polymer is a polyvinyl chloride.

4. The wall or ceiling panel assembly according to claim 3, wherein a mineral-based filler content of the base layer is above 40% in weight.

5. The wall or ceiling panel assembly according to claim 1, wherein the stiffening member comprises a thermoplastic polymer, said thermoplastic polymer having a Young's modulus at least one and a half times greater than the Young's modulus of the thermoplastic polymer of the base layer.

6. A wall or ceiling panel assembly comprising:

at least a first panel of a substantially rectangular or oblong shape provided with coupling means that are complementary to each other on at least a pair of opposite sidewalls of the panel, the coupling means being configured such that two of such panels are arranged to couple to each other in a plane of the panel, the panel comprising at least a base layer and a decorative layer, at least a second panel substantially similar to the first panel, wherein a coupling means of the first panel and a complementary coupling means of the second panel allow to assemble the first and second panels together by a movement of the coupling means of the second panel, relative to the complementary coupling means of the first panel, said movement being oriented:

in a direction substantially perpendicular to a plane of the panels, and towards the complementary coupling means of the first panel.

7. The wall or ceiling panel assembly according to claim 6, wherein a length of each panel is greater than 1600 mm.

8. The wall or ceiling panel assembly according to claim 6, wherein a composition of the base layer comprises a mineral-based filler above 40% in weight.

9. The wall or ceiling panel assembly according to claim 6, wherein a composition of the base layer comprises a thermoplastic material.

10. The wall or ceiling panel assembly according to claim 6, wherein a thickness of the panel is lower than 7 mm.

11. The wall or ceiling panel assembly according to claim 6, wherein a density of the base layer is greater than 1500 kg/m$^3$.

12. The wall or ceiling, comprising a wall or ceiling panel assembly according to claim 6, wherein the wall or ceiling further comprises a supporting structure comprising elongated members extending in a direction perpendicular to a length of the panels, said elongated members running substantially parallel to the wall or ceiling, wherein a distance between two neighboring elongated members of the supporting structure is smaller than 400 mm.

13. A wall or ceiling panel assembly comprising:

at least a first panel of a substantially rectangular or oblong shape, the panel having a front side and a back side and comprising:

at least a base layer and a decorative layer, wherein the decorative layer is applied on the side of the base layer directed to the front side of the panel, a tongue on at least a first sidewall of the panel, a groove in a sidewall opposite to the first sidewall, said tongue and said groove being configured such that two of such panels are arranged to couple to each other in a plane of the first panel;

wherein the wall or ceiling panel assembly further comprises at least a second panel similar to the first panel, a tongue of the second panel being coupled with a groove of the first panel, said tongue of the second panel is arranged to slide freely within said groove of the first panel in a direct to the sidewall opposite the first sidewall.

14. The wall or ceiling panel assembly according to claim 13, wherein the groove in the opposite sidewall defines an upper edge of the groove located closer to the front side of the panel, and a lower edge of the groove located closer to the back side of the panel, the decorative layer extending at least partially to an upper face of the tongue on the first sidewall, and to at least the upper edge of the groove.

15. The wall or ceiling panel assembly according to claim 13, wherein a composition of the base layer comprises a mineral-based filler above 40% in weight and wherein the composition of the base layer comprises a thermoplastic material.

16. The wall or ceiling panel assembly according to claim 13, wherein a thickness of the panel is less than 7 mm, and wherein a density of the base layer is greater than 1500 $kg/m^3$.

* * * * *